US005750917A

United States Patent [19]

Seckler et al.

[11] Patent Number: 5,750,917

[45] Date of Patent: May 12, 1998

[54] WARHEAD

[75] Inventors: Joachim Seckler, Augsburg; Klaus-Peter Geiss, Egenhofen, both of Germany

[73] Assignee: Daimler-Benz Aerospace AG, Ottobrunn, Germany

[21] Appl. No.: 489,921

[22] Filed: Feb. 26, 1990

[30] Foreign Application Priority Data

Mar. 1, 1989 [DE] Germany ..... 39 06 449.2

[51] Int. Cl.[6] ..... F42B 12/18

[52] U.S. Cl. ..... 102/476; 102/308

[58] Field of Search ..... 102/476, 308, 102/310

[56] References Cited

FOREIGN PATENT DOCUMENTS 2310547 12/1976 France ..... 102/476

3614883 10/1987 Germany ..... 102/476

2216240 10/1989 United Kingdom ..... 102/476

*Primary Examiner*—Harold J. Tudor

*Attorney, Agent, or Firm*—McGlew and Tuttle

[57] ABSTRACT

In a tandem warhead, the preliminary shaped charge (5) is arranged at the front end of a spacer (9) which is displaceable toward the front in a guide (12) provided in the preliminary structure (13) of the warhead. Shearing pins (14) are provided for fixing the spacer (9) in the pushed in position. A pyrotechnical element (16) is fastened at the spacer (9). The spacer (9) is provided at its rear end with an annular element (28) which contacts the lining (3) of the main charge (1) in the pushed in position. A pressure space (32) is accordingly formed, so that a high pressure is achieved when the pyrotechnical element (16) is fired, whereupon a recoil occurs due to the propellant gases of the pyrotechnical element (14) flowing out through nozzles (25), which recoil ensures a gentle starting of the spacer (9) into the moved out position.

3 Claims, 2 Drawing Sheets

WARHEAD

Figure 1:
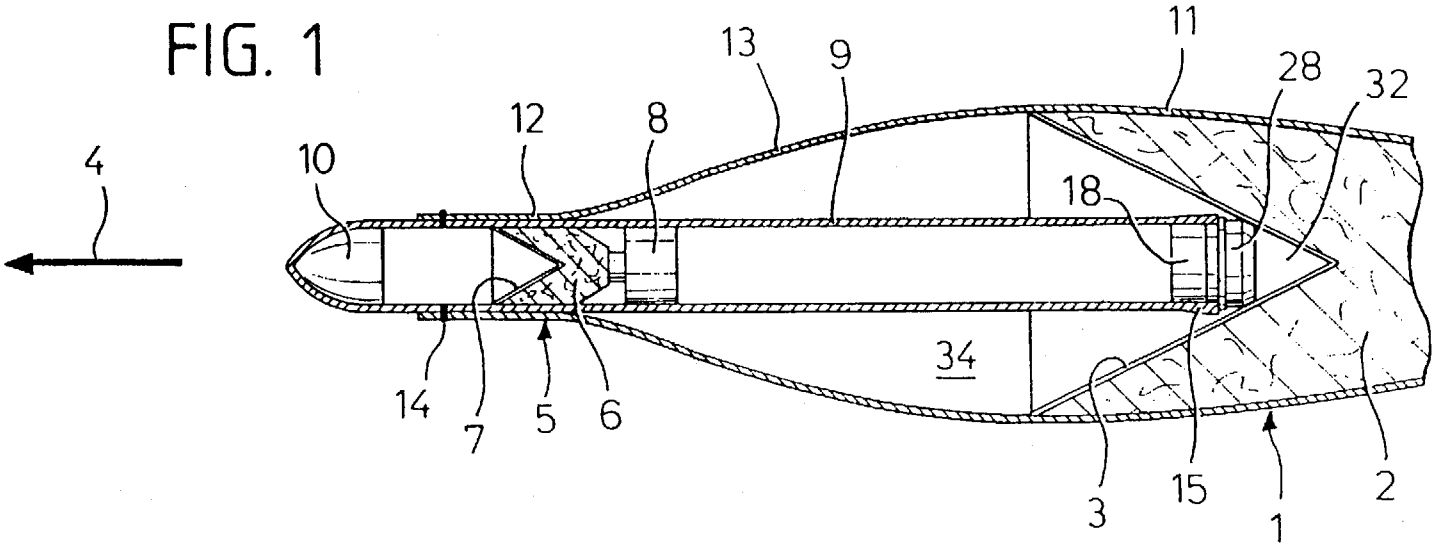

The invention is directed to a warhead comprising a main shaped charge and a preliminary shaped charge arranged prior to the main shaped charge in the flight direction, wherein the preliminary shaped charge is arranged at the front end of a spacer which is displaceable away from the main shaped charge toward the front in a guide provided in the preliminary structure of the warhead and comprising a pyrotechnical element.

Charges comprising a main shaped charge and a preliminary shaped charge arranged prior to the main shaped charge in the flight direction are also known as tandem charges. They are used against armored objects whose armor comprises active components against shaped charge jets. The preliminary shaped charge is fired first, its jet renders the active components of the active armor ineffective, so that on its path into the interior of the target the jet of the subsequently fired main shaped charge is spared any reciprocal action with the active components of the armor which reduce its effect.

Thus, the jet of the main shaped charge must impact against the armor with a corresponding time delay after the jet of the preliminary shaped charge. For this purpose there must be a relatively large distance between the preliminary shaped charge and the main shaped charge. This leads to a correspondingly large length of the warhead, which can result in aerodynamically unstable flight behavior of the warhead and other disadvantages.

A warhead with a tandem charge, is already known from FR-OS 2 310 547; the problem of aerodynamic instability during flight can be eliminated with the latter by means of displacing the preliminary shaped charge toward the front into the active position with a spacer.

However, in order for such a warhead to be operative, a device must be provided for fixing the spacer in its pushed in position which disengages when the spacer is displaced forward, in addition to a device which fixes the spacer in the pushed forward position.

The fixing device for the pushed in position is needed in order to exclude displacement of the spacer toward the front during land transportation in the tactical packaging. The fixing device for the pushed forward position is necessary so that the spacer is not pushed back by means of the wind pressure during the approach. It is necessary to produce a pressure by means of the pyrotechnical element, which pressure will not act upon the spacer with such large acceleration forces that the preliminary shaped charge, its safety device or other components are damaged when the spacer is moved out. For the same reason, no excessive braking forces may occur during the braking of the spacer at the end of the moving out process.

It is the object of the invention to provide an operative warhead, i.e. one fulfilling the above requirements, of the generic type mentioned above.

This is achieved, according to the invention, by means of the warhead characterized by a pyrotechnical element fastened at a spacer, and the spacer is provided at its rear end with an annular element with openings which, together with the spacer, enclose a pressure space in a pushed-in position by means of contacting the lining of the main shaped charge, as well as with at least one nozzle through which the propellant gases of the pyrotechnical element exit toward the rear in the direction of the lining of the main shaped charge. Advantageous constructions of the invention are indicated in the subclaims.

The invention is explained in more detail in the following with the aid of the attached drawings.

Figure 2:
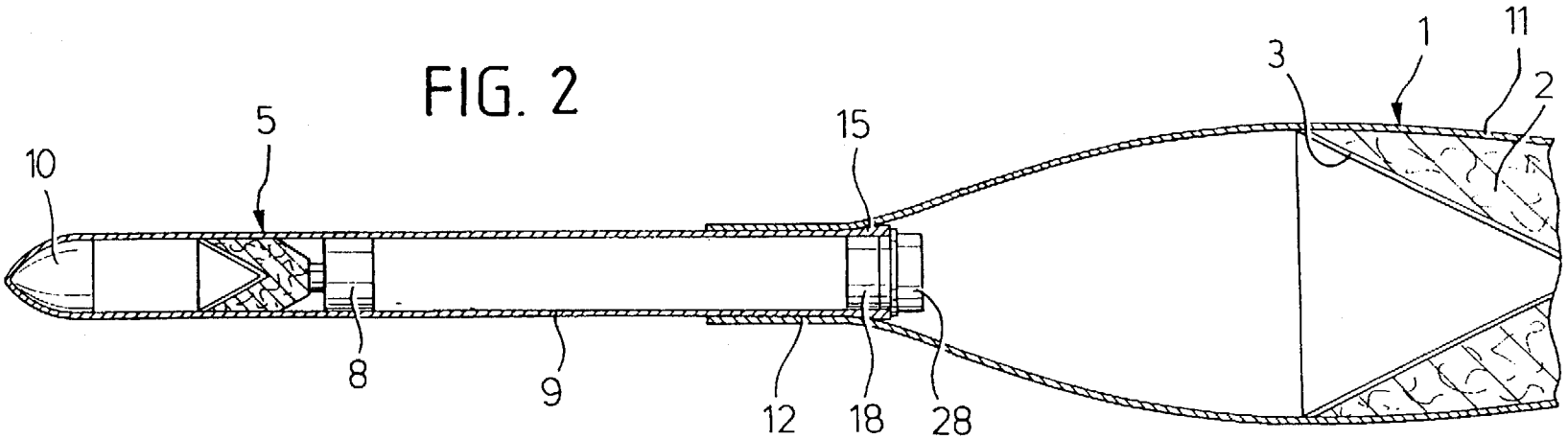
Figure 3:
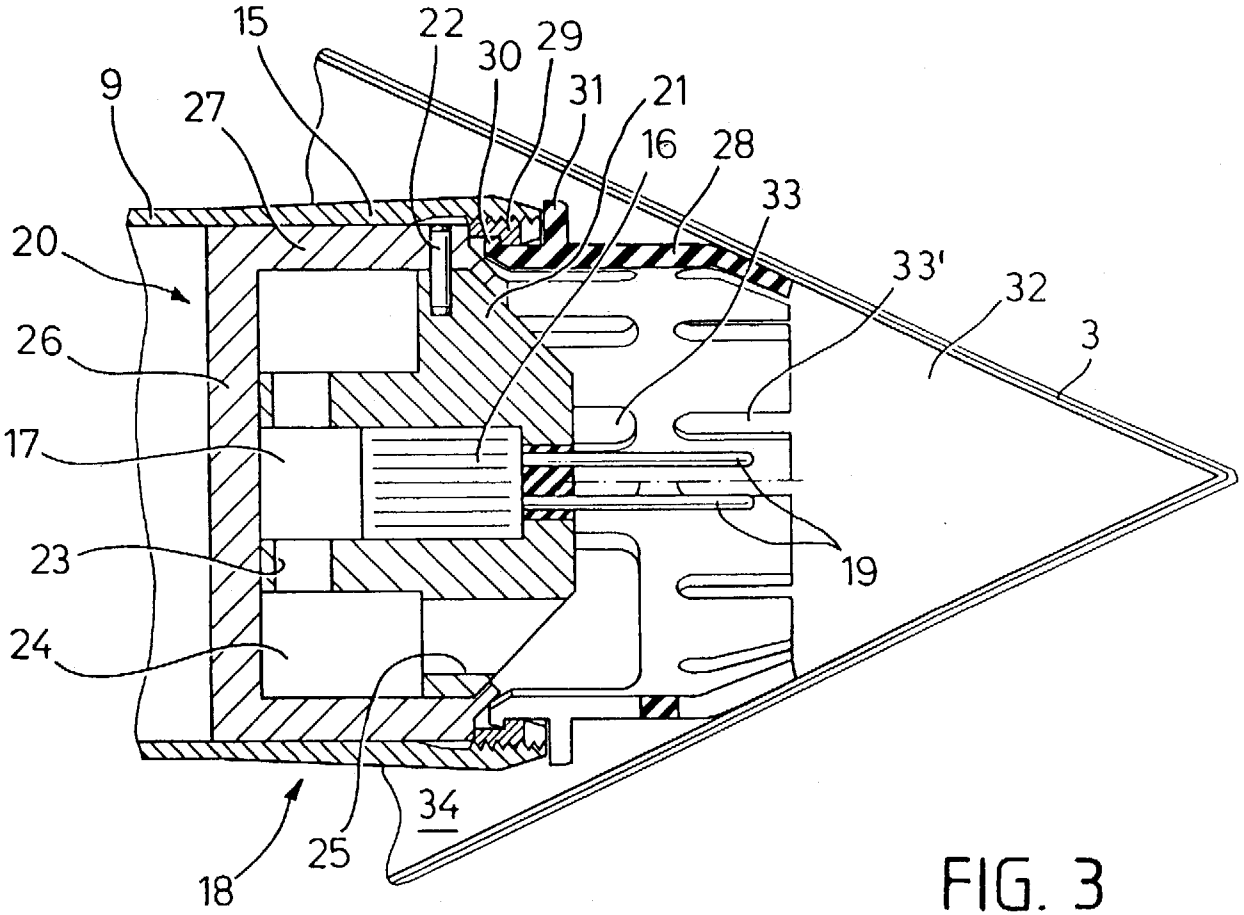

FIGS. 1 and 2 show a longitudinal section through a warhead in a schematic manner with the spacer in the pushed in and pushed forward positions, respectively; and FIG. 3 shows a section through the rear end of the pushed in spacer in enlarged view.

According to FIG. 1, a warhead comprises a main shaped charge 1 with an explosive charge 2 and a funnel-shaped lining 3 as well as a smaller preliminary shaped charge 5 which is prior to the main shaped charge 1 in the flight direction, according to arrow 4, and comprises an explosive charge 6 and a funnel-shaped lining 7 as well as a safety device 8.

The preliminary shaped charge 5 is arranged at the front end of a tubular spacer 9, a percussion fuse 10 being arranged in the ogival tip of the latter.

The tubular spacer 9 is displaceable from the pushed in rest position shown in FIG. 1 into the pushed out active position shown in FIG. 2 in a guide 12 at the front end of a preliminary structure 13 which tapers from the warhead jacket 11 toward the front. In the pushed in rest position, the spacer 9 is held by means of a fixing device which is formed by means of fixing pins 14 which connect the preliminary structure 13 with the spacer 9. The pins 14 are sheared off by means of the inertial forces of the spacer occurring due to launching acceleration and then open the way for the active position according to FIG. 2.

In the moved out active position according to FIG. 2, the spacer 9 is held in the guide 12 by means of a widening 15 of the outer diameter of the tubular spacer 9 in the guide 12 of the preliminary structure, wherein the widening 15 increases conically from the front to the back, so that the spacer 9 is braked gradually rather than suddenly when moved out if it is jammed with the widening 15 in the guide 12.

The spacer 9 is pushed out from the rest position according to FIG. 1 into the active position according to FIG. 2 by means of a pyrotechnical element 16. According to FIG. 3, the pyrotechnical element 16 is arranged in a chamber 17 in the center of a housing 18 which is fastened at the rear end area of the spacer 9.

The pyrotechnical element 16, which comprises a propellant charge and constitutes a commercially available part, is fired electrically via the lines 19 shown schematically in FIG. 3, wherein the firing is triggered by means of the launching signal of the missile with a determined time delay.

The housing 18 is formed by means of a pot-shaped outer part 20 and a cylindrical insert 21 which are connected with one another by means of a pin 22.

The chamber 17 is provided in the center of the cylindrical insert 21 for receiving the pyrotechnical element 16. Radial bore holes 23 extend in the insert 21 from the chamber 17 to an expansion chamber 24 arranged concentrically around the chamber 17. A plurality of recoil bore holes in the insert 21 lead from the expansion chamber 24 to the rear, wherein only one bore hole 25 is shown in FIG. 3. The recoil bore holes 25 form nozzles for the propellant gases of the propellant charge of the pyrotechnical element 16 which are flowing out to the rear.

The housing 18 and accordingly the interior of the tubular spacer 9 are terminated at the front by the base 26 of the pot-shaped outer part 20. At the same time, it closes the chamber 17 with the pyrotechnical element 16 at the front with its base 26 and closes the expansion chamber 24 provided in the insert 21 at the front and the sides with its base 26 and its outer jacket 27. An annular element 28 e.g. comprising plastic or another flexible material, such as silicone cork, extends toward the back from the housing 18 or the rear end of the spacer 9. The annular element 28 is fastened at a ring 29 which it engages from behind with an outer flange 30. The ring 29 is fastened between the rear end of the spacer 9 and the jacket 27 of the outer part 20 of the housing 18. A second outer flange 31 serves to further fasten that of the annular element 28 at the spacer 9.

The annular element 28 contacts the lining 3 of the main shaped charge 1 with its rear end portion in the pushed in rest position of the warhead shown in FIG. 3. It accordingly encloses a pressure or work space 32, specifically together with the lining 3 of the main shaped charge 1 and the housing 18 with the pyrotechnical element 16. The pressure space 32 is connected with the hollow space 34 between the spacer 9 and the jacket 11 or preliminary structure 13 of the warhead, respectively, by means of openings 33 in the annular element 28. Lamella are formed at the rear edge of the annular element 28 by means of slot-shaped openings 33', which lamella additionally facilitate its contact at the lining 3.

When the pyrotechnical element 16 is fired in the rest position shown in FIGS. 1 and 3, the annular element 28 first acts as a piston seal by means of the contact at the lining 3 of the main shaped charge 1.

After the pressure build-up of the fired pyrotechnical element 16, the annular element 28 disengages from the lining 3 of the main shaped charge 1 with the result that a pressure compensation occurs between the pressure space 32 and the hollow space 34.

The forward movement of the spacer can now cease due to the drop in pressure. The drive of the spacer 9 in the forward direction is now effected by means of the recoil of the nozzles 25, i.e. by means of the propellant gases flowing out of the nozzles 25 toward the rear in the direction of the lining 3 of the main shaped charge 1. The acceleration forces achieved are such that the spacer 9 is started gently, so that damage to the preliminary shaped charge 5, its safety device 8 and other components fastened at the spacer 9 is prevented. The pressure produced by the pyrotechnical element 16 reaches the expansion chamber 24 via the radial bore holes 23 so as to be distributed in a symmetrical manner and is subsequently given off to the rear in a metered manner via the recoil bore holes 25.

The short-term rise in pressure in the pressure space 32 is regulated by the number and magnitude of the openings 33 in the sleeve 28.

In order to prevent the aforementioned damage, the spacer 9 may also be braked only relatively slowly. This is likewise effected by means of the relatively small acceleration forces applied to the spacer 9 by means of the recoil nozzles 25. In addition, a gentle braking of the spacer 9 is achieved by means of the conical widening 15 at its outer circumference.

That is, in the warhead according to the invention the pyrotechnical element 16 enables a continuous pressure build-up in the pressure space 32 with subsequent thrust for reinforcing the moving out of the spacer 9 with the preliminary shaped charge 5 of a tandem warhead. The explosive pressure of the pyrotechnical element 14 is thus converted into a thrust in order to achieve a slow acceleration of the spacer 9 when moving out of the preliminary structure.

We claim:

1. Warhead having a flight direction and comprising a warhead jacket (11) having a first end leading in the flight direction, a preliminary structure (13) extending in the flight direction from the first end of said warhead jacket (11), a main shaped charge (1) within said warhead jacket (11) and a preliminary shaped charge (5) arranged ahead of the main shaped charge in the flight direction and located in a first position within said preliminary structure (13), said main shaped charge (1) having a first end leading in the flight direction, said preliminary shaped charge (5) has a first end leading in the flight direction and a second end trailing in the flight direction, a tubular spacer (9) extending in the flight direction within said warhead and having a first position therein with a second end thereof in the first position located within said warhead jacket (11) and a first end located within a guide (12) at a end of said preliminary structure (13), said spacer (9) being displaceable through said guide (12) from the first position to a second position with the second end of said spacer located adjacent said guide (12), a pyrotechnical element (16) located in a housing (18) in the second end of said spacer (9), said main shaped charge (1) having a lining at the first end thereof, said housing (18) including a pot-shaped part (20), an annular element (28) secured to the second end of said spacer (9) and in the first position of said spacer being in contacting engagement with the lining (3) of said main shaped charge (1), said annular element (28) defining an interior open space and in combination with said lining (3) and said spacer (9) forming a pressure space (32) at the first end of said main shaped charge (1), in the first position of said spacer (9) said spacer being spaced inwardly from said lining (3) and forming in combination therewith a hollow space (34), said annular element having first openings (33) therethrough communicating between said hollow space (34) and the interior open space in said annular element and second openings (33') spaced opposite to the flight direction from said first openings (33) and facilitating contact between said annular element (28) and lining (3), an insert (21) in said pot-shaped part (20) and forming therewith an expansion chamber (24) for receiving propellant gases from said pyrotechnical element (16), said insert (21) forming at least one nozzle (25) for flowing propellant gases from the expansion chamber (24) into the pressure space (32).

2. Warhead according to claim 1, wherein radial bore holes (23) extend from a chamber (17) in said insert (21) for receiving the pyrotechnical element (16) into said expansion chamber (24) arranged in the housing (18) concentrically around said chamber (17), and the at least one nozzle (25) extending opposite to the flight direction from the expansion chamber (24).

3. Warhead according to claim 2, wherein the pot-shaped part (20) has a base (26) closing the chamber (17) containing the pyrotechnical element (16) in flight direction and said pot-shaped part closes the expansion chamber (24) radially outwardly by said base (26) and a circumferentially extending outer jacket extending from said base opposite to the flight direction.

* * * * *